United States Patent [19]

Stenqvist

[11] Patent Number: 4,858,844

[45] Date of Patent: Aug. 22, 1989

[54] METHOD AND MACHINE FOR MANUFACTURING ROLLS OF BAGS

[75] Inventor: Jan N. Stenqvist, Kvidinge, Sweden

[73] Assignee: Fas Converting Machinery Aktiebolag, Ystad, Sweden

[21] Appl. No.: 116,193

[22] Filed: Nov. 3, 1987

[30] Foreign Application Priority Data

Nov. 5, 1986 [SE] Sweden ..... 8604755-2

[51] Int. Cl.[4] ..... B65H 18/08

[52] U.S. Cl. ..... 242/67.1 R; 225/106

[58] Field of Search ..... 225/93, 106; 242/56 R, 242/67.1 R, 68.4, 67.3 R, 672

[56] References Cited

U.S. PATENT DOCUMENTS

| | | | |
|---|---|---|---|
| 3,122,292 | 2/1964 | Ford et al. | 225/2 |
| 3,783,750 | 1/1974 | Heimeijer | 242/67.1 R X |
| 3,791,602 | 2/1974 | Isakson | 242/56 A |
| 3,791,603 | 2/1974 | Lenius | 242/56 R |
| 4,034,928 | 7/1977 | McDonald et al. | 242/67.1 R X |

FOREIGN PATENT DOCUMENTS

| | | |
|---|---|---|
| 2422161 | 11/1974 | Fed. Rep. of Germany . |
| 444667 | 4/1986 | Sweden . |
| 572432 | 2/1976 | Switzerland . |
| 1244992 | 9/1971 | United Kingdom . |

*Primary Examiner*—David Werner

*Attorney, Agent, or Firm*—Beveridge, DeGrandi & Weilacher

[57] ABSTRACT

In a method for manufacturing rolls of bags, a web having transverse lines of perforation is wound by means of a winding device. A leading end of the web is first conducted into the winding device which is activated for the winding operation. When a predetermined web length has been sensed, a clamping device clamps the web which is immediately torn off, and a new leading web end is gripped after a certain time delay by means of a gripping device. The finished roll of bags is thereafter released from the winding device which is reset for a new winding operation. Finally, the gripping device is moved past the winding device so that this can catch the web and commence a new winding cycle.

In addition to a winding device and a gripping device, a machine for manufacturing rolls of bags has two clamping jaws which are movable by means of quick-acting pneumatic cylinders into abutment against each other for clamping the web between them so that the web can be immediately severed during the continued winding by means of the winding device.

11 Claims, 2 Drawing Sheets

METHOD AND MACHINE FOR MANUFACTURING ROLLS OF BAGS

Figure 1:
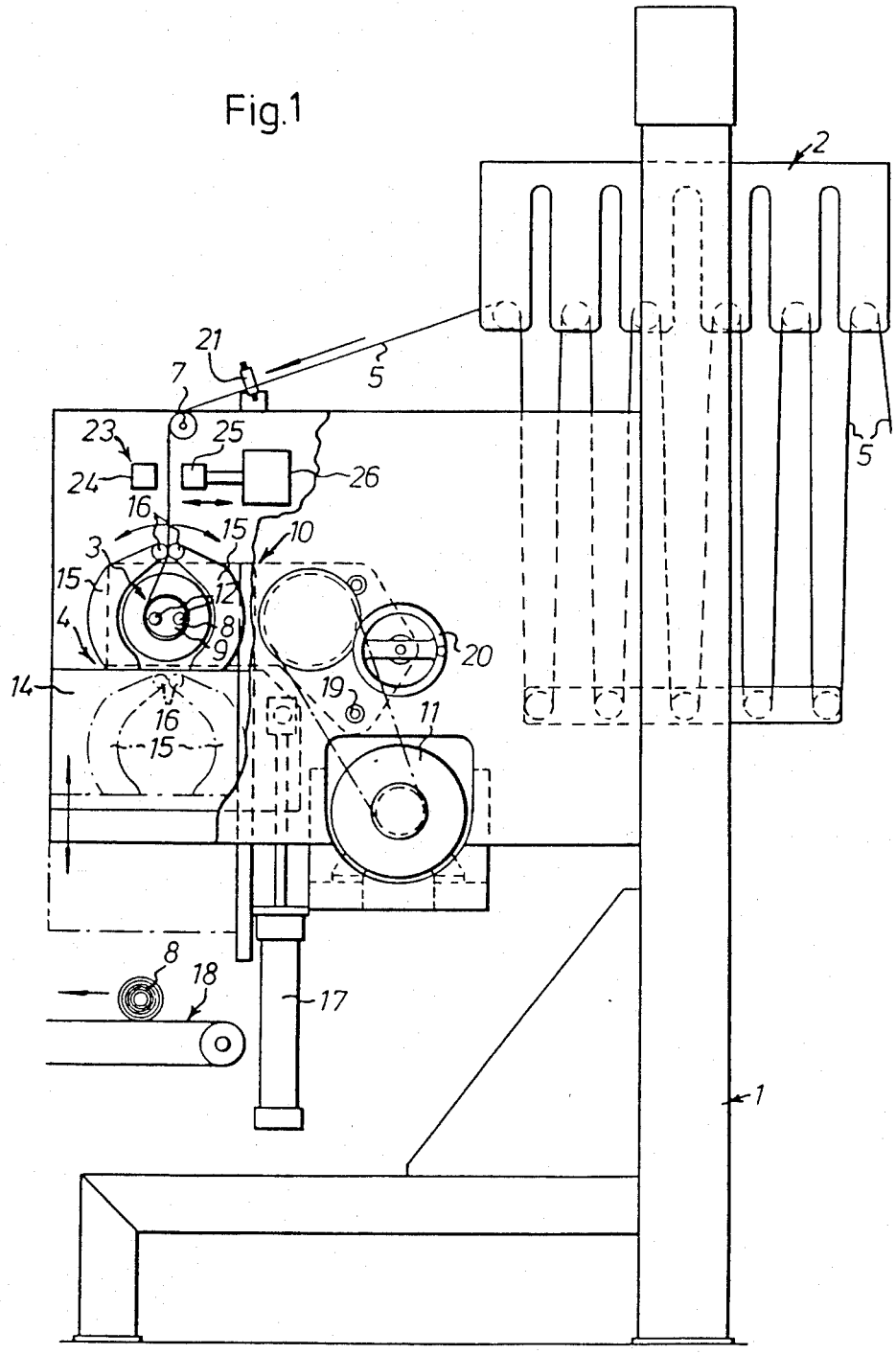

The present invention relates to the manufacture of rolls of bags and more particularly to a method for manufacturing bags of rolls by winding an elongate web having transverse lines of perforation, said method including the steps of winding the web by means of a winding device having two opposed pairs of spaced-apart fingers between which a leading end of the web is introduced and which are thereafter set in motion for winding the web into a roll of bags, severing the roll of bags after a predetermined web length has been wound, from succeeding parts of the web by tearing the web along a line of perforation at the end of the ready-wound roll of bags, gripping the web after completion of the winding operation by means of a gripping device located upstream of the winding device with respect to the direction of travel of the web, and thereafter conducting the leading end of the web in between said two opposed pairs of fingers by moving the gripping device in the direction of travel of the web past the winding device, such that the leading end of the web is seized by the winding device and a new winding cycle is commenced.

The invention further relates to a machine for manufacturing rolls of bags by winding an elongate web having transverse lines of perforation, said machine comprising a winding device having two opposed pairs of spaced-apart fingers between which a leading end of the web can be introduced and which are rotatable for winding the web into a roll of bags, and a gripping device located upstream of the winding device with respect to the direction of travel of the web, for gripping and moving a leading end of the web to a position between said two opposed pairs of fingers.

There are several different types of bag winding machines on the market today, in which an elongate web provided with perforations and welds in a preceding operation, is conducted via an intermediate-storage device to a winding device for winding rolls containing a certain number of bags. These winding machines cannot operate fully continuously since a switching operation is necessitated during which the web is torn off, the finished roll of bags is removed and the end of the web is finally seized for commencing a new winding cycle.

Laid-open application No. SE-B-444,667 discloses a bag winding machine which comprises a winding device for winding the rolls of bags and a vertically movable gripping device serving to grip the web upstream of the winding device, whereupon the web is severed in a special operation and the ready-wound roll of bags is dropped onto a belt conveyor. For the commencement of a new winding cycle, the gripping device is moved downwards past the winding device so that this can seize the web, whereupon the gripping device returns to its initial position upstream of the winding device.

Like other prior art bag winding machines, this patented machine, although of satisfactory operation, suffers from the drawback of operating intermittently. For each switching operation, the web must be stopped for a relatively long time and, also, the operation of the different devices of the machine must be interrupted and restarted repeatedly. In the above-mentioned prior art bag winding machines, the tearing or severing operation is performed in one step, whereupon the winding device in another step is set to a position suited for the next winding cycle. Because of these different steps, the entire switching operation will take an unreasonably long time. Another major drawback of the known machines is that the drive motor of the winding device is heavily strained by being restarted from a stationary state under load (stretched web) and by being rapidly braked for correctly positioning the web upon gripping. Since the development in this technical field moves towards increasingly continuously operating winding machines with increasing web speeds, there is a need for overcoming these drawbacks.

Another major drawback inherent in most prior art bag winding machines is that the braking of the web prior to the tearing operation depends on the web speed. When a predetermined web length corresponding to a certain amount of bags has passed a sensor, the web is braked in such a manner that the line of perforation where tearing should be effected is correctly positioned in the gripping device. Thus, a certain web length should be fed from the moment the sensor has sensed the existence of a ready-wound roll to the moment the web has been stopped in the tearing position. In practice, this web length is set as a function of a braking time and by means of a time relay which must be adjusted every time the web speed is changed. Since it must be possible to use different web speeds in production lines for manufacturing rolls of bags, it is highly disadvantageous to have to adjust the bag winding machine for each web speed.

In this context, it should also be pointed out that over the past years new materials have been developed for the manufacture of bags. With these new materials, the extruder by means of which the material is extruded into a tube, must be run faster, which means that it must also be possible to run the following machines in the production line, e.g. the bag winding machine, at higher speeds. Thus, there is a demand for a quick-operating bag winding machine capable of complying with the increase in web speed and, hence, in production made possible by the new materials.

The present invention therefore has for its object to provide a fast and simple method which is independent of the web speed, for manufacturing rolls of bags where particularly the switching operation, including the tearing of the web and the commencement of a new winding cycle, can be carried out in a short time.

Another object of the invention is to reduce the number of stops and restarts during the switching operation in order to gain time and to reduce the wear of the drive means.

A further object is to provide a machine for fast and simple manufacture of rolls of bags.

These and other objects indicated hereinafter have now been achieved by a method of the type stated in the introduction to this specification, wherein for severing the roll of bags, the web is first clamped by means of a clamping device located upstream of the gripping device with respect to the direction of travel of the web, in such a manner that the web is immediately torn off, whereupon the web after a predetermined time dealy is seized by the gripping device thus retaining the leading end of the web, and wherein the movement of the fingers is thereafter subjected to a braking action so as to directly reset said fingers to the starting position for a new winding cycle.

According to the invention, said objects are also achieved by a machine of the type stated in the introduction to this specification, which further comprises a clamping device for clamping the web, said clamping device being located upstream of the gripping device and comprising clamping means movable into abutment against each other for clamping the web therebetween and producing a consequent immediate tearing of the web along a line of perforation at the end of the ready-wound roll of bags during continued winding by means of the winding device.

Further embodiments of the method and the machine of the invention are recited in the accompanying claims.

In a practical application of the invention, the method and the machine have yielded very good results. Each switching operation has proved to take 2–2.5 s, to be compared with 4–4.5 s in many of the prior art machines. With an average web speed of 1 m/s and a web of 5 m in each roll, 6–7 rolls can be wound per minute, which means 6–7 switching operations. This saving of time in each switching operation means that the same number of rolls can instead be wound in about 40 s. The "flying" switching operation according to the invention thus gives a time-saving in the order of 30%, entailing a corresponding increase in production.

The bag winding machine according to the invention thus satisfies the requirements for an increase in speed linked with the newly developed bag materials as mentioned in the foregoing.

The invention will now be described in more detail hereinbelow with reference to the accompanying drawings showing a preferred embodiment of a machine for the application of the method according to the invention.

Figure 2:
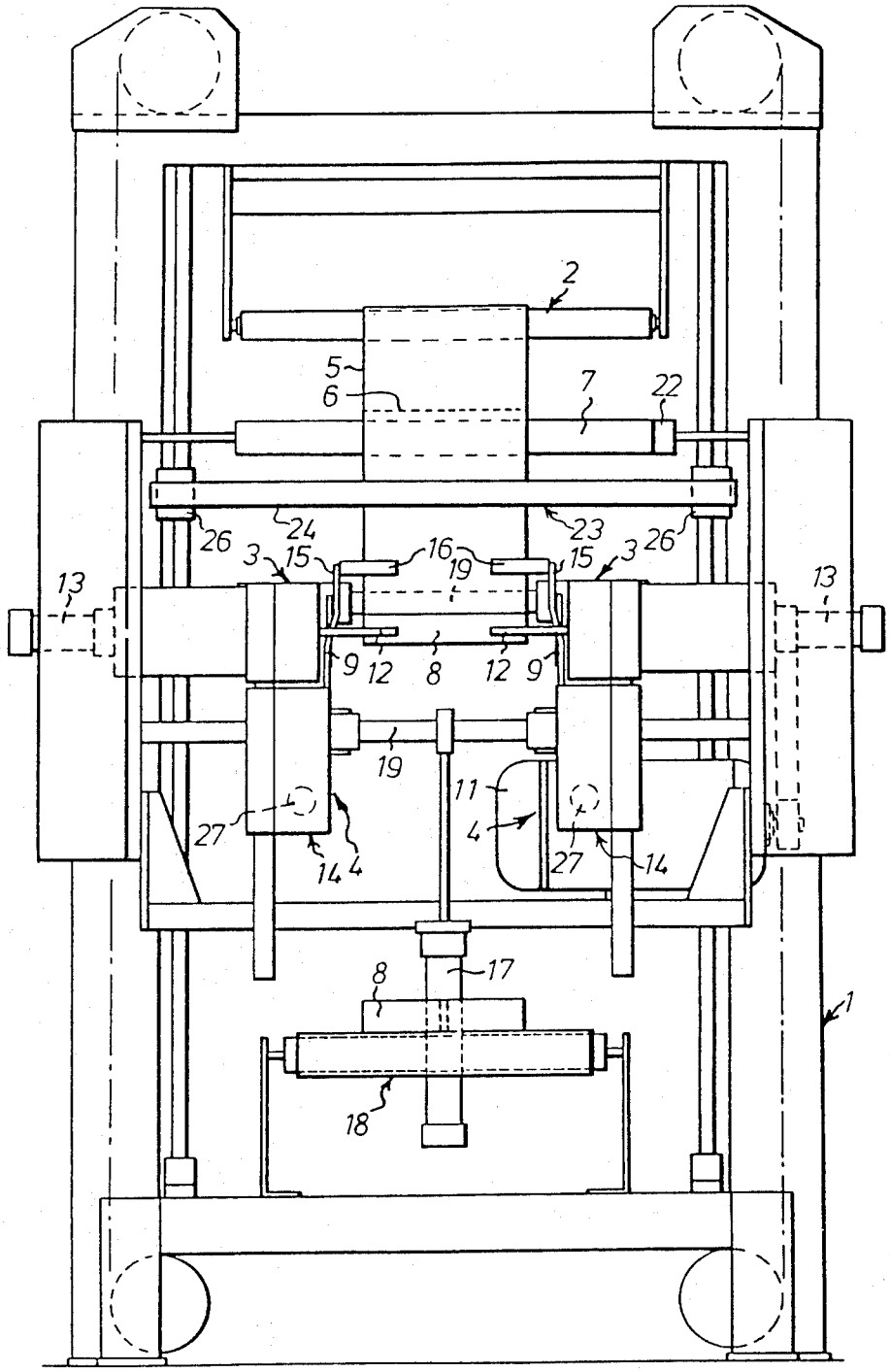

FIG. 1 is a side view schematically showing the machine according to the invention, and FIG. 2 is a front view of the same machine.

The bag winding machine illustrated in the drawings comprises a stand having an intermediate-storage device 2, a winding device 3 and a gripping device 4. The per se known intermediate-storage device 2 forms a buffer store to which a web 5 is continuously supplied from a bag making machine (not shown). The web 5 generally consists of a ready-folded and ready-welded plastic sheeting having transverse lines of perforation 6 defining the bags. The bag length and the web width can be varied depending on the desired bag size.

From the intermediate-storage device 2, the web 5 is conducted over a guide roller 7 down to the winding device 3 for winding the web 5 into rolls of bags 8.

The winding device 3 has two heads 9 which by a transmission 10 are rotated by means of an electric motor 11. On each head 9, there are mounted two spacedapart fingers 12 which are movable in their longitudinal direction, each by an air cylinder 13.

The pairs of fingers 12 are movable towards each other a predetermined distance, typically about 10 cm, so as to be located on both sides of the web 5. When the fingers 12 are set in motion by the action of the heads 9, the transmission 10 and the electric motor 11, the winding of the web 5 starts. As soon as a sensing device has sensed a predetermined number of perforation lines 6 corresponding to the desired number of bags in a roll 8, the movement of the fingers 12 is stopped. The bag winding machine shown in the drawings employs as sensing device or transducer a spark counter 21 (only schematically shown in FIG. 1) mounted upstream of the guide roller 7 in the stand 1 and emitting sparks through the lines of perforation 6 passing by, for counting these lines.

As shown in FIG. 2, there is provided in association with the guide roller 7 an angular transducer 22 which by an electronic equipment (not shown) cooperates with the spark counter 21 for sensing the distance a line of perforation 6 has moved after the spark counter.

A clamping device 23 disposed between the guide roller 7 and the gripping device 4 comprises a clamping jaw 24 fixedly mounted in the stand 1, and a movable clamping jaw 25 movable into abutment against the fixed clamping jaw 24 by means of two quick-acting air cylinders 26. When the air cylinders 26 are activated, the clamping jaw 25 connected thereto is struck against the fixed clamping jaw 24 for instantaneously clamping the web 5 located therebetween. The air cylinders 26 are of an extremely fast-operating type having a stroke time of about 10 ms. The distance between the clamping jaws 24 and 25 preferably is about 4 mm, and it will be obvious that the moving web 5 is immediately severed when the clamping jaw 25, by means of the air cylinders 26, rapidly strikes the fixed clamping jaw 24.

The gripping device 4 consists of two similar units 14 each having two arms 15 which are pivotable towards and away from each other and which at their free ends carry grippers 16. The pivotal movement of the arms 15 is produced by means of schematically illustrated air cylinders 27 having a stroke time of about 100 ms. The entire gripping device 4 is vertically movable by means of an air cylinder 17.

The switching of rolls of bags 8 by the method of the invention is performed in the following way. When the spark counter 21 has counted a predetermined web length, say 50 bags, a first signal is supplied to the angular transducer 22 which, after a predetermined angle or web length, i.e. when the last line of perforation 6 is situated immediately below the grippers 16, transmits a second signal, severing signal, to the quick-acting air cylinder 26 which is activated. At the severing signal, the web 5 is rapidly clamped between the clamping jaws 24 and 25, and the web 25 is immediately torn along the line of perforation 6 below the grippers 16. After this rapid clamping operation, the clamping jaws 24 and 25 are again moved apart. The severing signal simultaneously also activates the air cylinders 27 associated with each pair of arms 15, so that the grippers 16 will grip the freely hanging leading end of the web 5. Since the air cylinders 27 operate more slowly than the air cylinders 26, a time delay is obtained between the clamping and the gripping of the web 5 by the clamping device 23 and the gripping device 4, respectively.

After the web 5 has been severed, the fingers 12 are moved away from each other by means of the air cylinders 13, so that the finished roll of bags 8 will drop onto a subjacent belt conveyor 18 for further conveyance. Concurrently, the winding device 3, via the transmission 10, is gently braked by means of the electric motor 11 in such a manner that the fingers 12 are directly set to the starting position for a new winding cycle. When the fingers 12 have released the roll of bags 8, the air cylinder 17 is activated, such that the gripping device 4 and the grippers 16 gripping the web 5 are moved downwards to the position shown in broken lines in FIG. 1, whereby the web 5 will be correctly positioned between the opposed pairs of fingers 12. The fingers 12 are thereafter again moved towards each other and again set in motion for winding a new roll of bags 8. At the same instant, the grippers 16 release the web 5 and the gripping device 4 returns to its initial position.

By means of this bag winding machine, the switching operation becomes "flying" since the severing operation takes place at a very early stage and the free web end is seized with a very short time delay with respect to the severing operation. In previously known bag winding machines, the web is first seized simultaneously as the winding device is stopped, whereupon the roll of bags in a separate operation is further rotated for tearing off the web. Such stop and restart operations are dispensed with in the machine according to the present invention. Furthermore, the braking of the winding device becomes gentler, saving drive means and transmissions. Another advantage is that the restart of the winding device 3 takes place with a freely hanging web 5 since the clamping jaws 24, 25 are not clamping the web 5 at that stage. In this manner, the drive means will be less strained when restarted.

Another major advantage of the machine according to the invention is that the speed-dependent braking of the web 5 applied in prior art machines for causing the line of perforation 6 concerned to come to a correct tearing position between the grippers 16 and the winding device 3 is eliminated. Instead, a predetermined web length is measured by means of the angular transducer 22, which in combination with the quick tearing operation gives a far greater accuracy in respect of the positioning of the line of perforation 6 in the tearing position. In actual fact, this positioning becomes practically entirely independent of the web speed.

Finally, it should be pointed out that both the winding device 3 and the gripping device 4 can be divided into two units, whereby the bag winding machine can easily be adapted to web 5 of different widths, i.e. for bags of varying width. To this end, the winding and gripping devices 3 and 4, respectively, are so mounted on guides 19 as to be movable towards and away from each other. Such displacement/width adjustment is carried out by means of a hand wheel 20.

What I claim and desire to secure by Letters Patent is:

1. A method of manufacturing rolls of bags from an elongate web having transverse lines of perforation, said method comprising the steps of:

winding the web by means of a winding device having two opposed pairs of spaced-apart fingers;

introducing a leading end of the web between said two opposed pairs of fingers;

setting said two opposed pairs of fingers in motion for winding the web into a roll of bags;

severing the roll of bags from the web, after winding a predetermined length of the web, by clamping the web by means of a clamping device located upstream of said winding device relative to the direction of travel of the web, and tearing the web along a line of perforation at the end of the ready-wound roll of bags;

gripping a leading end of the web, after allowing a predetermined time delay for completion of said winding step, by means of a gripping device located upstream of said winding device relative to the direction of travel of the web;

subjecting said two opposed pairs of fingers to a braking action and resetting said fingers to a starting position for a new winding cycle;

conducting the leading end of the web between said two opposed pairs of fingers by moving said gripping device in the direction of travel of the web past said winding device, such that the leading end of the web is seized by said winding device; and commencing said new winding cycle.

2. A method as claimed in claim 1, further comprising:

positioning the line of perforation at the end of the ready-wound roll of bags by means of a first transducer by sensing a predetermined length of the web corresponding to a predetermined number of bags and activating a second transducer, and by sensing a predetermined length of the web and activating said clamping device for clamping and tearing the web along said positioned line of perforation.

3. A method as claimed in claim 2, wherein said clamping step further comprises bringing a movable clamping device, located on one side of the web, into abutment against another clamping device located on the other side of the web for clamping the web, and performing said clamping step during a relatively short period of time by means of a quick-acting pneumatic device, associated with said movable clamping device, having a stroke time of, for example, about 10 ms.

4. A method as claimed in claim 3, wherein said gripping step is time-delayed relative to said clamping step in that said gripping device is actuated by pneumatic means which have a longer stroke time, for example about 100 ms, than said pneumatic means of said clamping device.

5. A method as claimed in claim 4, wherein said clamping step and said gripping step performed by said clamping device and said gripping device, respectively, are initiated by one and the same signal.

6. An apparatus for manufacturing rolls of bags from an elongated web having transverse lines of perforation, comprising:

a winding device having two opposed pairs of spacedapart fingers which rotate and wind the web into a roll of bags;

a gripping device located upstream of said winding device relative to the direction of travel of the web, said gripping device gripping and positioning a leading end of the web between said two opposed pairs of fingers, a clamping device located upstream of said gripping device, said clamping device having clamping means movable to abut against each other for clamping the web therebetween and causing the web to tear along a line of perforation at the end of the readywound roll of bags due to continued winding of said winding device.

7. An apparatus as claimed in claim 6, further comprising:

a first transducer sensing a predetermined length of the web corresponding to a predetermined number of bags, and a second transducer sensing a predetermined length of the web, positioning the line of perforation at the end of the readywound roll of bags, and activating said clamping device to clamp and tear the web.

8. An apparatus as claimed in claim 7, wherein said clamping means comprise two elongate clamping jaws arranged on both sides of the web transversely of the direction of travel thereof, one of said clamping jaws being fixedly mounted and the other of said clamping jaws being movably-mounted.

9. An apparatus as claimed in claim 8, wherein said movable clamping jaw is connected to at least one quick-acting pneumatic cylinder having a stroke time of about 10 ms.

10. An apparatus as claimed in claim 9, wherein said gripping device operates by means of a pneumatic cylinder having a longer stroke time, for example about 100 ms, than said pneumatic cylinder of said clamping device.

11. An apparatus as claimed in claim 10, wherein said pneumatic cylinders of said clamping device and said gripping device are simultaneously activated by one and the same signal, but with a mutual time delay.

* * * * *